US011930846B2

(12) United States Patent
Liu

(10) Patent No.: US 11,930,846 B2
(45) Date of Patent: Mar. 19, 2024

(54) ATOMIZER AND ELECTRONIC CIGARETTE COMPRISING THE SAME

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 216 days.

(21) Appl. No.: 17/500,922

(22) Filed: Oct. 13, 2021

(65) Prior Publication Data

US 2022/0287363 A1 Sep. 15, 2022

(30) Foreign Application Priority Data

Mar. 11, 2021 (CN) ..... 202110267434.8
Mar. 11, 2021 (CN) ..... 202120519954.9

(51) Int. Cl.

| | |
|---|---|
| ***A24F 47/00*** | (2020.01) |
| ***A24F 40/10*** | (2020.01) |
| ***A24F 40/42*** | (2020.01) |
| ***A24F 40/485*** | (2020.01) |

(52) U.S. Cl.
CPC ..... *A24F 40/42* (2020.01); *A24F 40/10* (2020.01); *A24F 40/485* (2020.01)

(58) Field of Classification Search
CPC ..... A24F 40/42; A24F 40/10; A24F 40/485
See application file for complete search history.

(56) References Cited

U.S. PATENT DOCUMENTS

| | | | | |
|---|---|---|---|---|
| 5,687,912 | A * | 11/1997 | Denyer | B05B 7/0012 |
| 9,596,887 | B2 * | 3/2017 | Newton | A24F 47/008 |
| 2013/0019862 | A1 * | 1/2013 | Yamada | A24F 40/485 128/200.21 |
| 2013/0228191 | A1 * | 9/2013 | Newton | A24F 47/00 |
| 2016/0227837 | A1 * | 8/2016 | Hammel | A24F 47/00 |
| 2017/0105451 | A1 * | 4/2017 | Fornarelli | A24F 47/008 |

FOREIGN PATENT DOCUMENTS

| | | | | |
|---|---|---|---|---|
| EP | WO 2018/046530 A1 * | 6/2017 | | A24F 47/00 |

* cited by examiner

*Primary Examiner* — Eric Yaary
(74) *Attorney, Agent, or Firm* — MATTHIAS SCHOLL P.C.; Matthias Scholl

(57) ABSTRACT

An atomizer includes an e-liquid tank. The e-liquid tank includes an e-liquid chamber and an air vent communicating with the e-liquid chamber.

11 Claims, 8 Drawing Sheets

ATOMIZER AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202110267434.8 filed Mar. 11, 2021, and to Chinese Patent Application No. 202120519954.9 filed Mar. 11, 2021. The contents of all of the aforementioned applications, including any intervening amendments thereto, are incorporated herein by reference.

BACKGROUND

The disclosure relates to an atomizer and an electronic cigarette comprising the same.

In conventional atomizers, negative pressure is generated in the e-liquid tank after each puff. If external air is not supplied quickly enough, the e-liquid doesn't flow to the heating element. As a result, the heating element may experience a burn-out during the subsequent puff. In addition, when the cigarette is not in use, the atomized e-liquid tends to condense and may flow outside of the atomizer via the air passage, thus staining the atomizer.

SUMMARY

An objective of the disclosure is to provide an atomizer comprising an e-liquid tank; the e-liquid tank comprises an e-liquid chamber and an air vent communicating with the e-liquid chamber.

In a class of this embodiment, the air vent is in the form of an air channel or a hole.

In a class of this embodiment, a diameter of the air channel or the hole is 0.01-0.3 mm.

In a class of this embodiment, the atomizer further comprises an airflow channel communicating with the air vent.

In a class of this embodiment, the e-liquid tank comprises a main body and a sealing member; the e-liquid chamber is disposed in the main body; the sealing member is disposed on one end of the main body to seal the e-liquid chamber; a junction between the sealing member and the main body comprises the air channel functioning as the air vent.

In a class of this embodiment, the main body comprises at least one groove at the junction between the main body and sealing member, and/or the sealing member comprises at least one groove at the junction between the main body and sealing member; and the at least one groove is a part of the air channel.

In a class of this embodiment, the groove has a depth of 0.01-0.3 mm and a width of ≤2 mm.

In a class of this embodiment, the sealing member comprises plastic material.

In a class of this embodiment, the main body comprises an air duct disposed in the e-liquid chamber; the sealing member comprises an inner passage; the air duct is disposed into the inner passage; the sealing member is disposed through the air duct to seal the e-liquid chamber; the air duct comprises a peripheral wall and at least one first groove disposed on the peripheral wall; the at least one first groove communicates with the e-liquid chamber and the inner passage.

In a class of this embodiment, the sealing member comprises an inner wall comprising a step abutting against the air duct; one end of the air duct abutting against the step comprises a second groove corresponding to the at least one first groove; a first end of the at least one first groove is connected to a first end of the second groove; a second end of the at least one first groove communicates with the e-liquid chamber; and a second end of the second groove communicates with the air duct.

In a class of this embodiment, the atomizer further comprises a heating element disposed in the inner passage.

In a class of this embodiment, the atomizer further comprises an e-liquid collector disposed below the sealing member; the e-liquid collector comprises an e-liquid collection chamber communicating with the inner passage of the sealing member; the e-liquid collector comprises an outer wall comprising an air groove, at least one first air inlet and at least one second air inlet which communicate with the air groove; the air groove is disposed into the main body, so that an air conduction space is formed between an inner wall of the main body and the outer wall of the e-liquid collector; the at least one first air inlet communicates with the e-liquid collection chamber; the at least one second air inlet communicates with atmosphere; and the at least one first air inlet communicates with the at least one second air inlet via the air conduction space.

In a class of this embodiment, the sealing member comprises at least one baffle extending into the e-liquid collection chamber; the at least one baffle is configured to cover the at least one first air inlet.

In a class of this embodiment, the e-liquid collector comprises a closed bottom end and an air passage formed on the closed bottom end and isolated from the e-liquid collection chamber; the at least one second air inlet is disposed on a top wall of the air passage and communicates with atmosphere through the air passage.

Another objective of disclosure is to provide an electronic cigarette; the electronic cigarette comprises the atomizer and a power supply configured to supply power to the atomizer; the power supply includes, but is not limited to, a battery, a USB interface, a control board, and a button.

The following advantages are associated with the atomizer and the electronic cigarette of the disclosure: the atomizer comprises the air vent configured to supply air into the e-liquid tank, which provides an adequate and stable supply of e-liquid airflow to prevent the heating element from burning out, thereby prolonging the life of the heating element and enhancing user experience.

Figure 1:
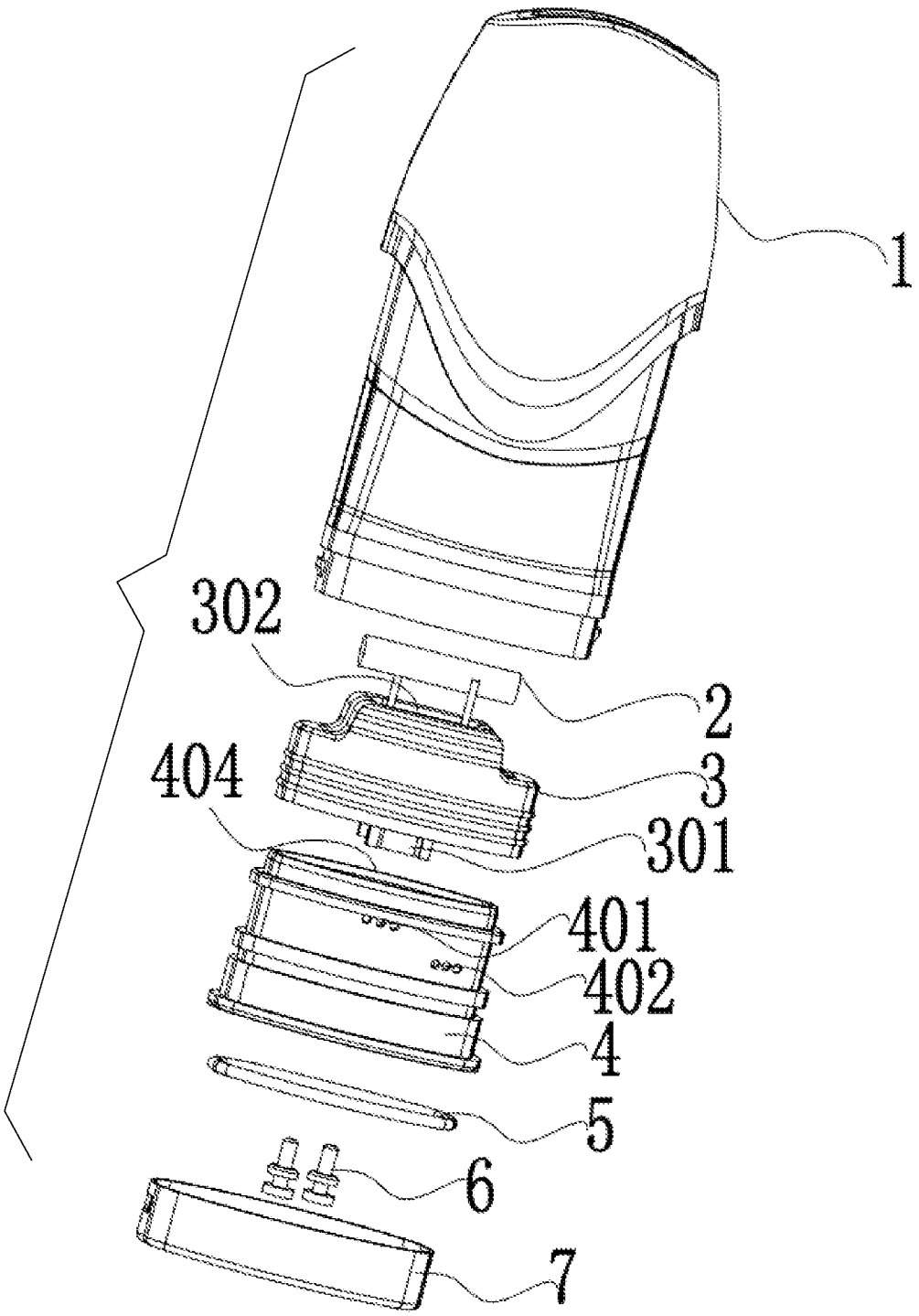
FIG. 1 is an exploded view of an atomizer according to one embodiment of the disclosure.
Figure 2:
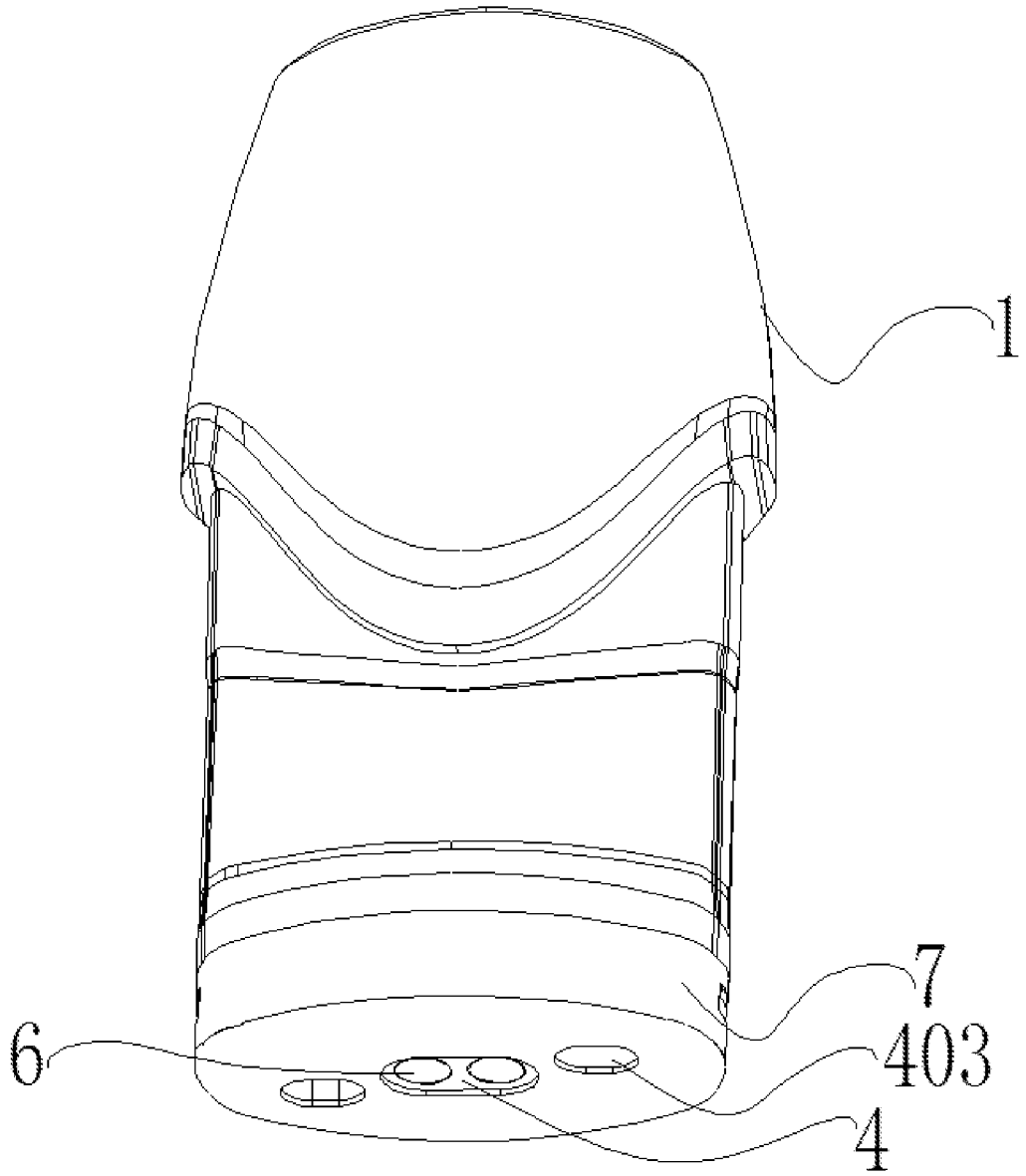
FIG. 2 is a perspective view of an atomizer according to one embodiment of the disclosure.
Figure 3:
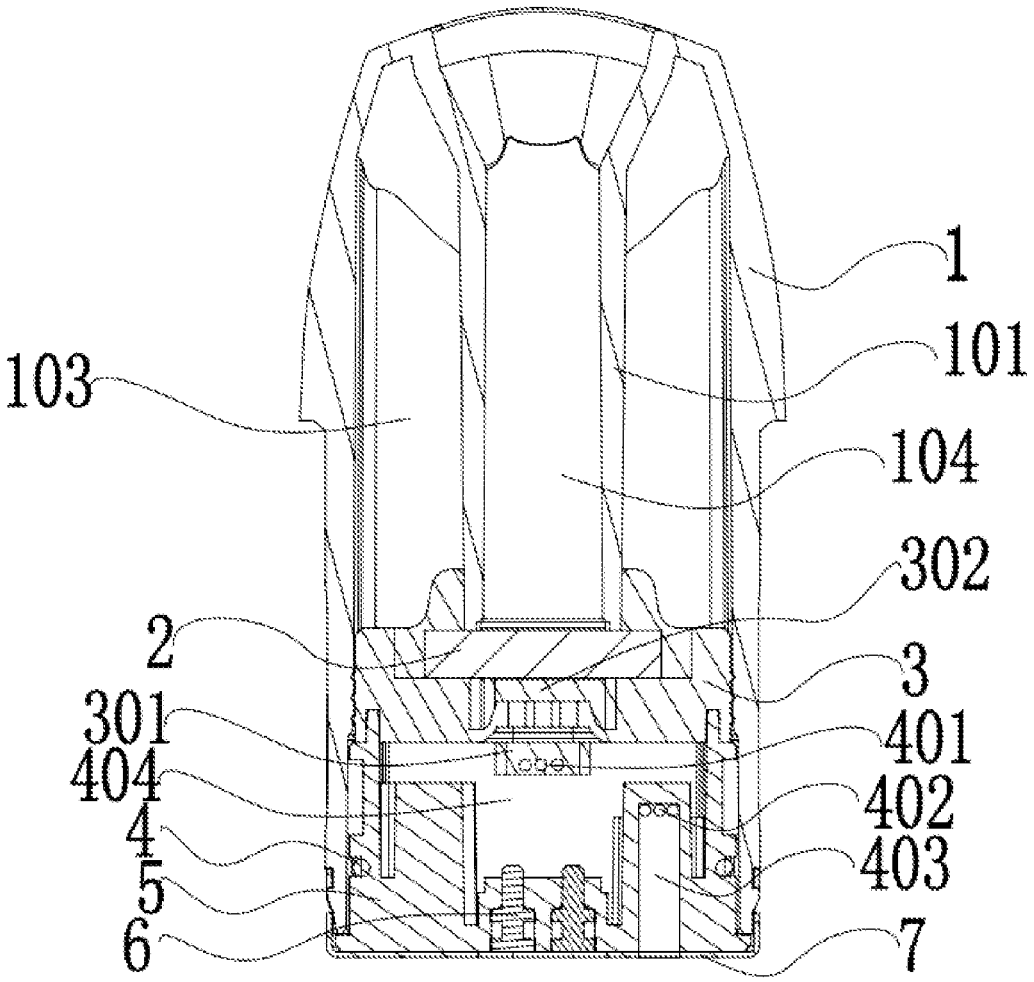
FIG. 3 is a cross-sectional view of an atomizer according to one embodiment of the disclosure.
Figure 4:
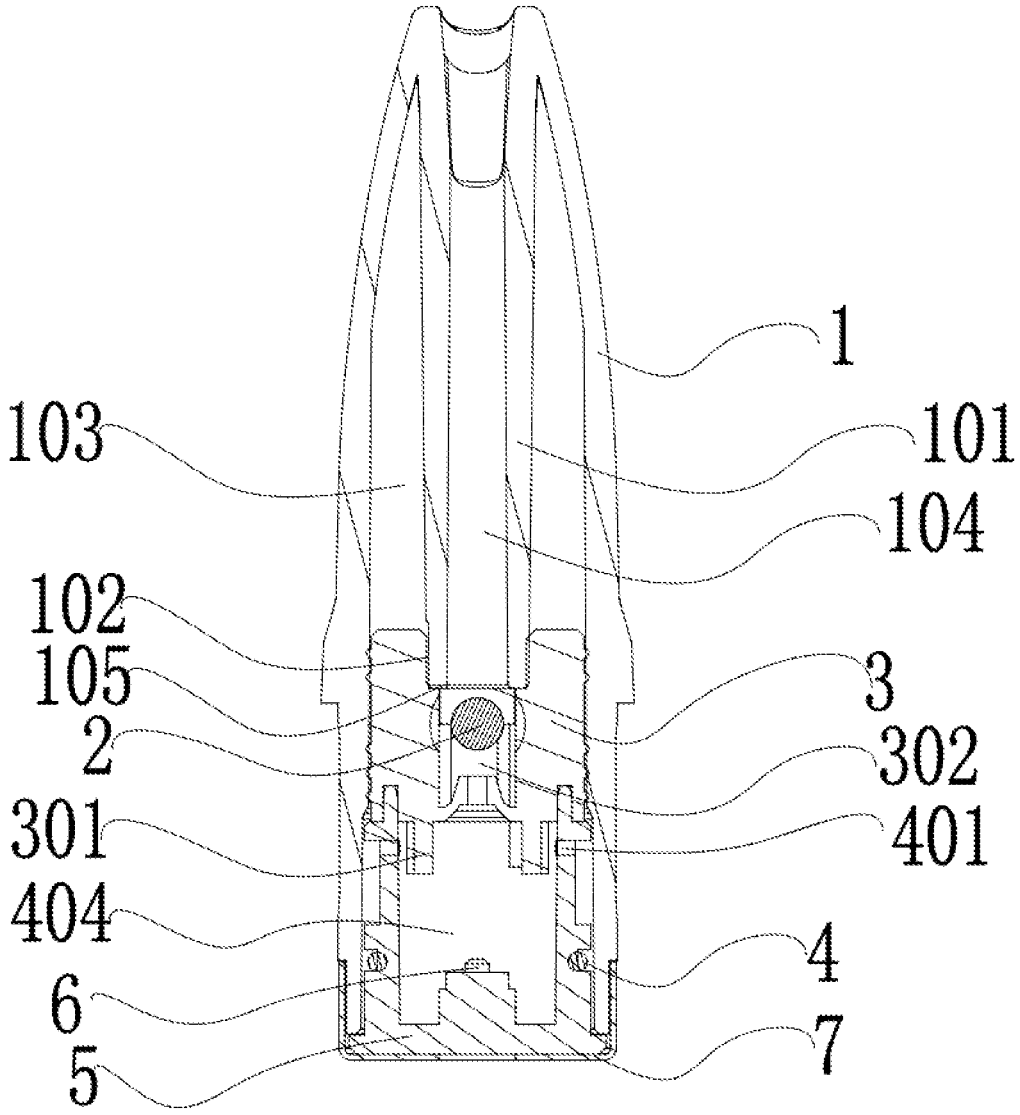
FIG. 4 is another cross-sectional view of an atomizer according to one embodiment of the disclosure.

In the drawings, the following reference numbers are used: 1. Main body; 2. Heating element; 3. Sealing member; 4. E-liquid collector; 5. Seal ring; 6. Electrode; 7. Iron housing; 101. Air duct; 102. First groove; 103. E-liquid chamber; 104. Airflow channel; 105. Second groove; 302. Inner passage; 401. First air inlet; 402. Second air inlet; 403. Air passage; and 404. E-liquid collection chamber.

DETAILED DESCRIPTION

To further illustrate, embodiments detailing an atomizer are described below. It should be noted that the following embodiments are intended to describe and not to limit the disclosure.

Referring to FIGS. 1-4, an electronic cigarette comprises an atomizer and a power supply. The atomizer comprises an e-liquid tank comprising an e-liquid chamber 103 for storage of volatile materials, such as e-liquid and aromatic oil. The e-liquid tank further comprises an air vent communicating with the e-liquid chamber 103.

The atomizer further comprises an airflow channel 104 communicating with the air vent. The atomizer communicates with atmosphere through the airflow channel 104, thereby allowing air and smoke to flow through. The term "airflow channel" as used herein refer to an entire channel through which airflow enters the electronic cigarette and passes through a heating element 2 to drives smoke and vapor to flow out of the electronic cigarette.

External air flows along the airflow channel, through the air vent, and into the e-liquid chamber, to supply air into the e-liquid tank. The air vent allows only air to flow through while preventing the passage of the e-liquid. Preferably, the air vent communicates with atmosphere. Negative pressure is generated in the e-liquid chamber due to a gradual decrease in amount of the volatile materials during smoking. The negative pressure results in unstable supply of e-liquid, thereby affecting atomization process, and diminishing user experience. External air is supplied into the e-liquid tank via the air vent to balance the air pressure inside and outside the e-liquid chamber, thereby providing smooth airflow, preventing the heating element 2 from burning out, and prolonging atomizer life.

The air vent is in the form of an air channel or a hole. A diameter of the air channel or the hole is 0.01-0.3 mm, preferably 0.05 mm-0.2 mm, and more preferably 0.08 mm-0.12 mm. For example, the diameter of the air channel or the hole is 0.01 mm, 0.05 mm, 0.07 mm, 0.08 mm, 0.09 mm, 0.095 mm, 0.1 mm, 0.105 mm, 0.11 mm, 0.12 mm, 0.13 mm, 0.15 mm, 0.2 mm, 0.25 mm, or 0.3 mm.

The e-liquid tank comprises a main body 1 and a sealing member 3. The sealing member 3 is disposed into the main body 1 to seal the e-liquid chamber 103. The sealing member 3 abuts against the main body 1 to form a junction comprising the air channel. The air channel is disposed at the junction of any two components of the e-liquid tank, but is not limited to, the junction between the sealing member 3 and the main body 1. The hole is disposed on the side wall, the top wall, or the bottom wall of the e-liquid tank.

The main body 1 comprises at least one groove at the junction between the main body 1 and the sealing member 3, and/or the sealing member 3 comprises at least one groove at the junction between the main body 1 and sealing member 3; and the at least one groove is a part of the air channel. That is, the at least one groove is disposed on the main body 1, or on the sealing member 3, or on both and merge into the air channel. The at least one groove has a depth of 0.01-0.3 mm and a width of ≤2 mm; and/or the sealing member 3 comprises plastic material. Preferably, the depth of the at least one groove is, preferably, 0.05-0.2 mm, or more preferably 0.08-0.12 mm. For example, the depth of the at least one groove may be 0.01 mm, 0.05 mm, 0.07 mm, 0.08 mm, 0.09 mm, 0.095 mm, 0.1 mm, 0.105 mm, 0.11 mm, 0.12 mm, 0.13 mm, 0.15 mm, 0.2 mm, 0.25 mm, or 0.3 mm. Preferably, the width of the at least one groove is ≤1 mm, which prevents the sealing member from falling into the at least one groove, allowing air to flow through the air vent. The plastic material includes, but is not limited to, plastics and rubber.

Figure 5:
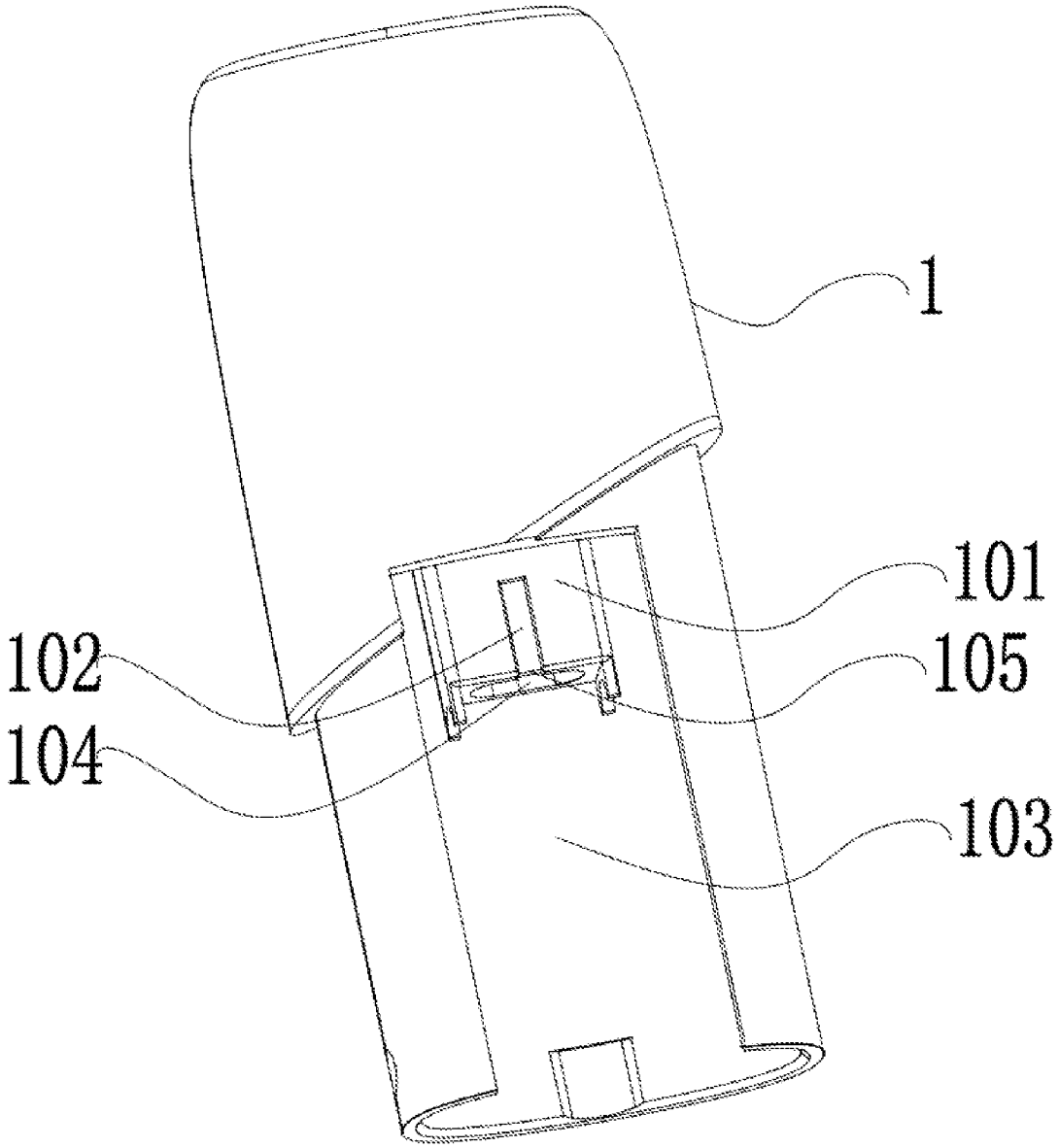
FIG. 5 is an enlarged perspective view of an atomizer according to one embodiment of the disclosure.

The main body 1 comprises a housing and a through hole is disposed on one end of the housing. The main body further comprises an air duct 101 extending from the through hole toward a second end of the inside of the housing. The air duct 101 is disposed in the e-liquid chamber 103. Referring to FIG. 5, both ends of the air duct 1 are disposed in the housing.

The sealing member 3 comprises an inner passage 302, a first portion and a second portion. The first portion is integrated with the second portion to form a shape of a Chinese character tu. The air duct 101 is disposed into the inner passage 302 and the second portion abuts against the air duct 101 to seal the e-liquid chamber 103.

In certain embodiments, the air duct 101 comprises a peripheral wall and at least one first groove 102 disposed on the peripheral wall. The at least one first groove 102 communicates with the e-liquid chamber 103 and the inner passage 302, respectively. The airflow channel comprises the inner passage 302 and the air duct 101. External air flows into the inner passage for atomization. The vapor and smoke generated passes through the air duct 101 and is inhaled by a user. When the air vent comprises only the at least one first groove 102, the at least one first groove 102 communicates with atmosphere through the inner passage 302.

Referring to FIG. 5, in certain embodiments, the inner passage 302 abuts against the first end of the air duct 101 to form a step inside the sealing member 3. The first end of the air duct 101 comprises a second groove 105. A first end of the at least one first groove 102 is connected to a first end of the second groove 10; a second end of the at least one first groove 102 communicates with the e-liquid chamber 103; a second end of the second groove 105 communicates with the air duct 101. The at least one first groove 102 communicates with the second groove 105 to form the air channel that communicates with atmosphere through the air duct 101.

The air vent comprises the air channel formed by the at least one first groove 102 and the second groove 105. External air flows through the air duct 101, the second groove 105, the at least one first groove 102, and into the e-liquid chamber 103.

In certain embodiments, the at least one first groove 102 is disposed on a middle or top portion of an outer wall of the air duct 101. The e-liquid tank further comprises a ring and the at least one first groove 102 comprises a first opening and a second opening. The first opening communicates with the air duct 101. The ring is disposed around an edge of the second opening. The ring is configured to prevent the e-liquid from flowing out of the at least one first groove 102. Outside air flows through the air duct 101, the first opening, the at least one first groove 102, the ring, and into the e-liquid chamber 103. In certain embodiments, the at least one first groove 102 is disposed on a middle or top portion of an inner wall of the air duct 101. The second opening communicates with the air duct 101. The ring is disposed around an edge of the first opening. Outside air flows through the air duct 101, the ring, the at least one first groove 102, the second opening, and into the e-liquid chamber 103.

Figure 6:
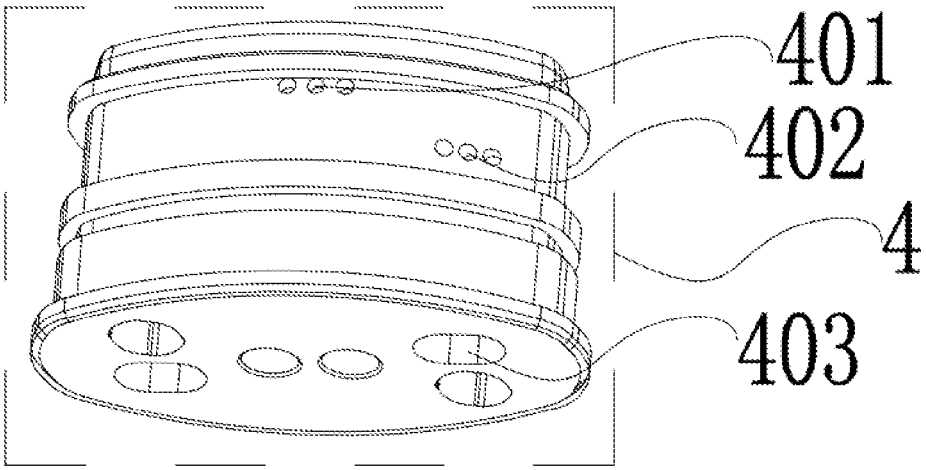
FIG. 6 is a perspective view of an e-liquid collector according to one embodiment of the disclosure.

Referring to FIG. 6, the electronic cigarette further comprises an e-liquid collector 4 disposed below the sealing member 3; the e-liquid collector 4 abuts against a bottom portion of the main body 1 to form an air conduction space; the e-liquid collector 4 comprises an e-liquid collection chamber 404, at least one first air inlet 401, and at least one second air inlet 402; the at least one first air inlet 401 and the at least one second air inlet 402 are disposed in the air conduction space; the at least one first air inlet 401 is disposed above the at least one second air inlet 402 and communicates with the at least one second air inlet 402 and the e-liquid collection chamber 404. Specifically, the e-liquid collector 4 is disposed below the sealing member 3; the e-liquid collector 4 comprises the e-liquid collection chamber 404 communicating with the an inner passage 302; the e-liquid collector 4 comprises an outer wall provided with an air groove; the air groove comprises the at least one first air inlet 401 and the at least one second air inlet 402; the air groove is disposed into the main body 1 to form the air conduction space between the main body 1 and the air groove; the e-liquid collection chamber 404 communicates with the at least one first air inlet 401; the at least one first air inlet 401 communicates with the at least one second air inlet 402 through the air conduction space; and the at least one second air inlet 402 communicates with atmosphere. The airflow channel 104 further comprises the air conduction space. External air flows through the at least one second air inlet 402, the air conduction space, the at least one first air inlet 401, the e-liquid collection chamber 404, the sealing member 3, and the heating element 2 successively, and is discharged out of the air duct 101.

The sealing member 3 comprises at least one baffle 301 protruding from the bottom surface of the second portion. The sealing member 3 is disposed on the e-liquid collector 4 to form the e-liquid collection chamber 404; the e-liquid collection chamber 404 communicates with the inner passage 302 of the sealing member 3; the at least one baffle 301 is disposed in the e-liquid collection chamber 404 to protect the at least one first air inlet 401 from the condensed e-liquid. The word "covering" refers to enclosing the at least one first air inlet 401 at front, top, left, and right sides to prevent excess vapor from condensing into liquid, except for the bottom side for smoke emission. In the airflow channel 104, the excess vapor is condensed into the e-liquid, flows into the e-liquid collection chamber 404, and is diverted by the at least one baffle 301, which prevent the condensing vapor from flowing into the at least one air inlet 401 and/or other outlets, thereby avoiding leakage around the outside of the atomizer.

Figure 7:
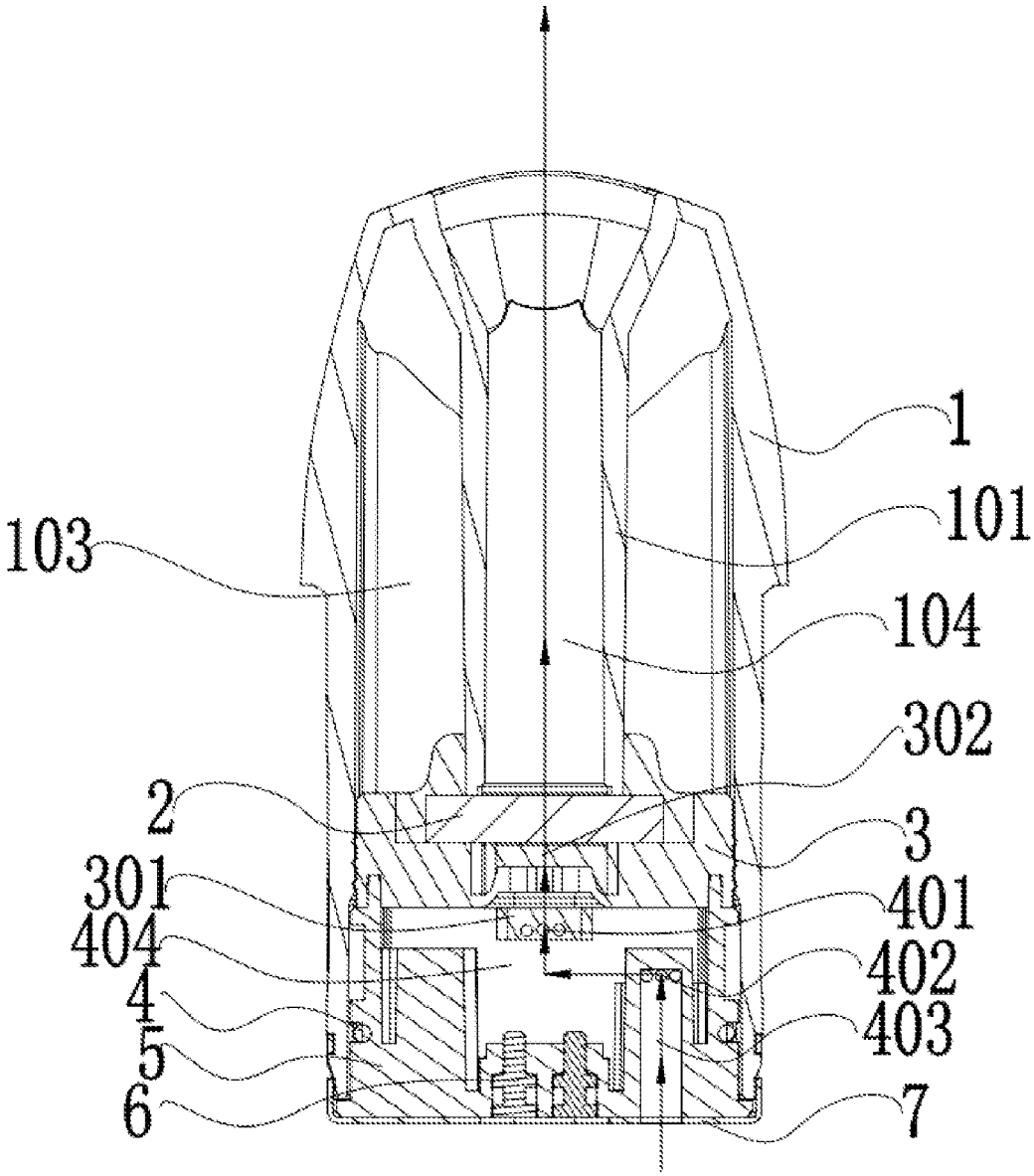
FIG. 7 is a cross-sectional view including arrows showing the direction of airflow in an atomizer according to one embodiment of the disclosure.

Referring to FIG. 7, the e-liquid collector 4 comprises a closed bottom end and an air passage 403 formed on the closed bottom end and isolated from the e-liquid collection chamber 404; the at least one second air inlet 402 is disposed on a top portion of a side wall of the air passage 403 and communicates with atmosphere through the air passage 403. External air passes through the air passage 403, the at least one second air inlet 402, the air conduction space, the at least one first air inlet 401, the inner passage 302, and the air duct 101. The e-liquid collector 4 is sealed at the bottom and the air passage is recessed into the bottom, so that the air passage 403 and the e-liquid collection chamber 404 are separated by an inner wall and are independent of each other. The inner wall is a part of a wall of the e-liquid collection chamber 404. Outside air flows through the air passage 403 and enters the at least one second air inlet 402 into the air conduction space.

The heating element 2 is disposed in the inner passage 302 to atomize the e-liquid. The heating element 2 comprises a cotton, as well as a metal heating component and/or a ceramic heating component wrapped with the cotton. The heating element 2 is horizontally disposed in the inner passage 302. A central part of the heating element 2 is disposed through the air duct and is configured to heat the e-liquid. Both ends of the heating element 2 are disposed in the e-liquid chamber 103 to receive the e-liquid.

The cotton is configured to absorb the e-liquid, includes but is not limited to, an e-liquid absorbing cotton, a linen cotton, an organic cotton, and a composite cotton. The metal heating component is configured to atomize the e-liquid and comprises iron, chromium, nickel, alloy metal, or ceramic. The e-liquid flows through both ends of the heating element 2 to the central part and is atomized therein to produce smoke or vapor. The smoke or vapor generated flows through the inner passage 302 into the air duct 101 and is inhaled by a user.

Referring to FIG. 5, the atomizer comprises the main body 1, the heating element 2, the sealing member 3, the e-liquid collector 4, a seal ring 5, two electrodes 6, and an iron housing 7. The sealing member 3 is disposed on the e-liquid collector 4 to prevent leakage of the e-liquid in the e-liquid chamber. The main body 1 comprises the air duct 101 that allows air and smoke to flow through. The air duct 101 comprises the at least one first groove 102 and the at least one second groove 105. The first end of the at least one first groove 102 is connected to the first end of the at least one second groove 105. The second ends of the at least one first groove 102 communicates with the e-liquid chamber 103. The second end of the second groove 105 communicates with the air duct 101. The sealing member 3 comprises the inner passage 302 communicating with the air duct 101 and the at least one second groove 105. The inner passage 302 is configured to allow smoke, vapor, and air to flow through. The sealing member 3 is disposed into the main body 1. The inner passage 302 communicates with the second groove 105 to form the air channel that allows air to flow through. External air flows through the air duct 101, the air channel, and into the e-liquid chamber, to supply air into the e-liquid tank. The air channel allows only air to flow through while preventing the passage of the e-liquid, so that air is supplied to the e-liquid chamber 103 to balance the air pressure inside and outside the e-liquid chamber 103, thus increasing a flow rate of the e-liquid in the e-liquid chamber 103. The sealing member 3 is disposed on the e-liquid collector 4 to form the e-liquid collection chamber 404. The sealing member 3 comprises at least one baffle 301 protruding into the e-liquid collection chamber 404. The e-liquid collector 4 abuts against a bottom portion of the main body 1 to form an air conduction space. The e-liquid collector 4 comprises the outer wall provided with the at least one first air inlet 401 and the at least one second air inlet 402. The at least one first air inlet 401 and the at least one second air inlet 402 are disposed in the air conduction space for air flow. The at least one first air inlet 401 is disposed above the at least one second air inlet 402 and communicates with the at least one second air inlet 402. The at least one baffle 301 is disposed in the e-liquid collection chamber 404 to protect the at least one first air inlet 401 from the condensed e-liquid and prevent the condensed e-liquid from flowing into the at least one air inlet 401, thereby avoiding leakage around the outside of the atomizer. The e-liquid collector 4 comprises a closed bottom end and an air passage 403 formed on the closed bottom end. The at least one second air inlet 402 communicates with atmosphere through the air passage 403. The heating element 2 is disposed in the sealing member 3 and the e-liquid is atomized on the central part of the heating element 2. The central part of the heating element 2 is disposed through the air duct 101 and in the inner passage 302. The at least one second air inlet 402 communicates with the air duct 101. Both ends of the heating element 2 are disposed in the e-liquid chamber 103, so that the e-liquid in the e-liquid chamber 103 flows through the both ends to the central part of the heating element and is atomized therein to produce smoke and vapor. The seal ring 5 is disposed between an outer wall of the e-liquid collector 4 and an inner wall of the main body 1 to seal the air conduction space. The heating element 2 comprises two pins and the two electrodes 6 are disposed on a bottom surface of the inside of the e-liquid collector 4 to secure to the two pins. The iron housing 7 abuts against the bottom portion of the main body 1, thus preventing damage to the bottom portion of the main body 1 through thermal expansion.

FIG. 6 is a perspective view illustrating the specific positions where the at least one first air inlet 401, the at least one second air inlet 402, and the air passage 403 are disposed on the e-liquid collector 4.

FIG. 7 is a cross-sectional view including arrows showing the direction of airflow in the atomizer according to one embodiment of the disclosure. External air flows through the air passage 403, the at least one second air inlet 402, the air conduction space, the at least one first air inlet 401 and the inner passage 302, causing the heating element 2 to atomize the e-liquid. The smoke and vapor flows through the air duct 101 and is inhaled by a user.

Figure 8:
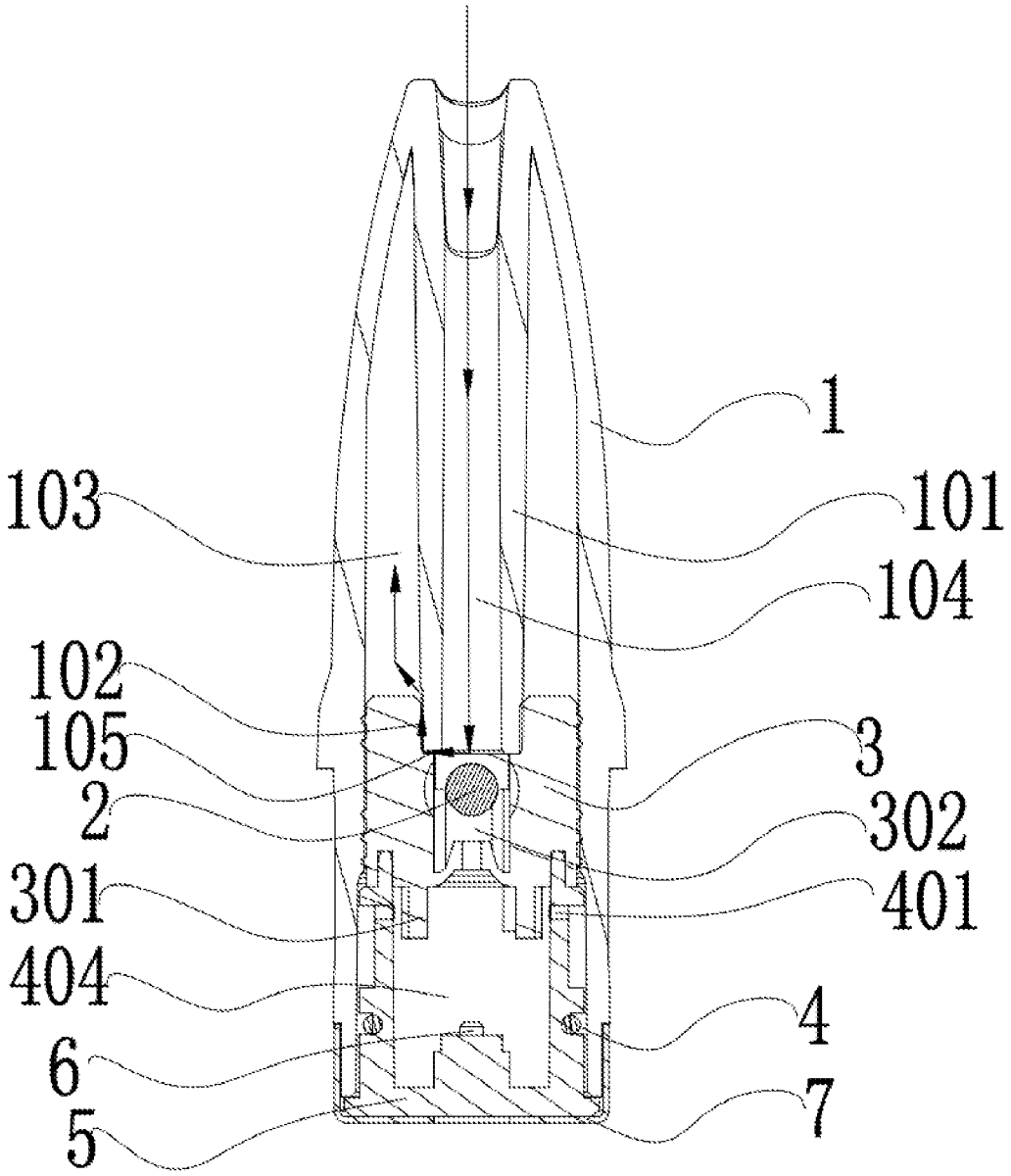
FIG. 8 is a cross-sectional view including arrows showing the direction of supplemental air in a main body according to one embodiment of the disclosure.

FIG. 8 is a cross-sectional view including arrows showing the direction of supplemental air in the main body according to one embodiment of the disclosure. External air flows through the air duct 101, the second groove 105, the first groove 102 and the air channel, to supply air into the e-liquid chamber 103.

It will be obvious to those skilled in the art that changes and modifications may be made, and therefore, the aim in the appended claims is to cover all such changes and modifications.

The invention claimed is:

1. An atomizer, comprising an e-liquid tank; the e-liquid tank comprising an e-liquid chamber, an air vent communicating with the e-liquid chamber, an airflow channel, a main body, and a sealing member; wherein:

the e-liquid chamber is adapted to store an e-liquid;

the sealing member comprises an inner passage, and the inner passage is adapted for atomizing the e-liquid to produce vapor;

the airflow channel is adapted to convey the vapor out of the atomizer;

the airflow channel is communicating with the air vent;

the air vent is in the form of an air channel, and the air vent is adapted to introduce external air into the e-liquid chamber through the airflow channel;

the e-liquid chamber is disposed in the main body; the sealing member is disposed on one end of the main body to seal the e-liquid chamber; a junction between the sealing member and the main body comprises the air channel; and the main body comprises at least one groove at a junction between the main body and the sealing member, or the sealing member comprises at least one groove at the junction between the main body and the sealing member; and the air channel comprises the at least one groove.

2. The atomizer of claim 1, wherein a diameter of the air channel or the hole is 0.01-0.3 mm.

3. The atomizer of claim 1, wherein the groove has a depth of 0.01-0.3 mm and a width of ≤2 mm.

4. The atomizer of claim 1, wherein the sealing member comprises plastic material.

5. The atomizer of claim 1, wherein the main body comprises an air duct disposed in the e-liquid chamber; the air duct is disposed into the inner passage; the sealing member is disposed through the air duct to seal the e-liquid chamber; the air duct comprises a peripheral wall and at least one first groove disposed on the peripheral wall; the at least one first groove communicates with the e-liquid chamber and the inner passage.

6. The atomizer of claim 5, wherein the sealing member comprises an inner wall comprising a step abutting against the air duct; one end of the air duct abutting against the step comprises a second groove corresponding to the at least one first groove; a first end of the at least one first groove is connected to a first end of the second groove; a second end of the at least one first groove communicates with the e-liquid chamber; and a second end of the second groove communicates with the air duct.

7. The atomizer of claim 1, wherein the atomizer further comprises a heating element disposed in the inner passage.

8. The atomizer of claim 1, wherein the atomizer further comprises an e-liquid collector disposed below the sealing member; the e-liquid collector comprises an e-liquid collection chamber communicating with the inner passage of the sealing member; the e-liquid collector comprises an outer wall comprising an air groove, at least one first air inlet and at least one second air inlet which communicate with the air groove; the air groove is disposed into the main body, so that an air conduction space is formed between an inner wall of the main body and the outer wall of the e-liquid collector; the at least one first air inlet communicates with the e-liquid collection chamber; the at least one second air inlet communicates with atmosphere; and the at least one first air inlet communicates with the at least one second air inlet via the air conduction space.

9. The atomizer of claim 8, wherein the sealing member comprises at least one baffle extending into the e-liquid collection chamber; the at least one baffle is configured to cover the at least one first air inlet.

10. The atomizer of claim 8, wherein the e-liquid collector comprises a closed bottom end and an air passage formed on the closed bottom end and isolated from the e-liquid collection chamber; the at least one second air inlet is disposed on a top wall of the air passage and communicates with atmosphere through the air passage.

11. An electronic cigarette, comprising the atomizer of claim 1 and a power supply configured to supply power to the atomizer.

* * * * *